US008579238B2

(12) United States Patent
Jones

(10) Patent No.: US 8,579,238 B2
(45) Date of Patent: Nov. 12, 2013

(54) SYSTEM AND METHOD FOR HANGING OBJECTS FROM A ROOF GUTTER

(76) Inventor: Dennis J. Jones, Shoals, IN (US)

( * ) Notice: Subject to any disclaimer, the term of this patent is extended or adjusted under 35 U.S.C. 154(b) by 53 days.

(21) Appl. No.: 13/184,157

(22) Filed: Jul. 15, 2011

(65) Prior Publication Data

US 2013/0014448 A1 Jan. 17, 2013

(51) Int. Cl.

| | |
|---|---|
| ***E04D 13/064*** | (2006.01) |
| ***E04D 13/072*** | (2006.01) |
| ***A47H 1/10*** | (2006.01) |
| ***E04D 13/00*** | (2006.01) |

(52) U.S. Cl.

USPC .... 248/48.1; 248/48.2; 248/237; 248/231.31; 248/317; 248/300; 52/11; 52/12; 52/15; 294/24; 254/15; 254/17

(58) Field of Classification Search

USPC ..... 248/48.1, 48.2, 237, 231.31, 317, 300; 52/11, 12, 15; 294/19.1, 24; 254/15, 17

See application file for complete search history.

(56) References Cited

U.S. PATENT DOCUMENTS

| | | | | | |
|---|---|---|---|---|---|
| 1,308,066 | A | * | 7/1919 | Hayes | 248/211 |
| D55,792 | S | * | 7/1920 | Hudgins | D8/89 |
| 3,239,172 | A | * | 3/1966 | Chalmers | 248/48.2 |
| D214,988 | S | * | 8/1969 | Isley | D8/89 |
| 3,592,721 | A | * | 7/1971 | Formanek | 428/121 |
| 3,599,918 | A | * | 8/1971 | Patchett | 248/85 |
| 4,216,564 | A | * | 8/1980 | Froutzis | 16/93 D |
| 4,631,875 | A | * | 12/1986 | Olson | 52/12 |
| 4,811,475 | A | * | 3/1989 | Morton, Jr. | 29/521 |
| 5,141,192 | A | * | 8/1992 | Adams | 248/231.81 |
| 5,181,683 | A | * | 1/1993 | Smith | 248/231.31 |
| 5,417,015 | A | * | 5/1995 | Coyne | 52/11 |
| 5,581,956 | A | | 12/1996 | Fennessy et al. | |
| 5,669,709 | A | * | 9/1997 | Adams | 362/396 |
| 5,746,461 | A | | 5/1998 | Broberg | |
| 5,979,852 | A | * | 11/1999 | Levesque | 248/339 |
| 6,092,339 | A | * | 7/2000 | Hall et al. | 52/11 |
| D436,823 | S | * | 1/2001 | Wrensch | D8/89 |
| 6,182,933 | B1 | * | 2/2001 | Rapp | 248/231.81 |
| 6,273,385 | B1 | * | 8/2001 | Hambleton | 248/304 |
| 6,347,780 | B1 | | 2/2002 | Holbrook | |
| 6,352,291 | B1 | * | 3/2002 | Tortajada | 294/24 |
| D469,682 | S | | 2/2003 | Gary et al. | |
| 6,536,727 | B1 | | 3/2003 | Limber et al. | |
| 6,644,836 | B1 | | 11/2003 | Adams | |
| 6,669,067 | B2 | | 12/2003 | Schuster | |
| 6,783,103 | B2 | | 8/2004 | Salani | |

(Continued)

*Primary Examiner* — Terrell McKinnon
*Assistant Examiner* — Christopher Garft
(74) *Attorney, Agent, or Firm* — Faegre Baker Daniels LLP

(57) ABSTRACT

A gutter hanger system includes a gutter having an outer wall, an inner wall in spaced relation to the outer wall, and a base connecting the outer wall and the inner wall; a support surface supporting the inner wall; and a gutter hanger including opposing top and bottom ends, a coupling member located at the bottom end, and a retainer located at the top end. The gutter hanger is positioned intermediate the inner wall and the support surface, oriented in a downward direction, and the retainer is positioned atop the inner wall. A method for installing a gutter hanger system includes the steps of providing a gutter, providing a support surface to which an inner wall of the gutter is attached, inserting a gutter hanger intermediate the support surface and the inner wall of the gutter, and retaining a top end of the gutter hanger on the inner wall of the gutter.

18 Claims, 15 Drawing Sheets

(56) References Cited

U.S. PATENT DOCUMENTS

| | | | | |
|---|---|---|---|---|
| 6,883,768 | B1 | 4/2005 | Morin | |
| 6,932,310 | B1 * | 8/2005 | Diss | 248/301 |
| 6,935,074 | B2 * | 8/2005 | Gramling | 52/11 |
| 7,287,354 | B2 * | 10/2007 | Rivers et al. | 52/220.1 |
| 7,357,360 | B2 * | 4/2008 | Staggs | 248/48.1 |
| 7,488,018 | B2 * | 2/2009 | Rommelmann, Jr. | 294/209 |
| 7,641,356 | B2 * | 1/2010 | Pieroth | 362/130 |
| 7,958,677 | B2 * | 6/2011 | Gramling | 52/11 |
| 2003/0094822 | A1 * | 5/2003 | Hill et al. | 294/19.1 |
| 2003/0134071 | A1 * | 7/2003 | Sung | 428/40.1 |
| 2006/0053696 | A1 * | 3/2006 | Gramling | 52/11 |
| 2007/0114337 | A1 * | 5/2007 | Rommelmann, Jr. | 248/48.2 |
| 2008/0141595 | A1 * | 6/2008 | Lawler | 52/15 |
| 2009/0095848 | A1 | 4/2009 | Holbrook et al. | |
| 2009/0255190 | A1 * | 10/2009 | Kennedy | 52/11 |
| 2011/0211356 | A1 * | 9/2011 | Blincoe et al. | 362/396 |
| 2011/0233359 | A1 * | 9/2011 | Rittner et al. | 248/231.81 |

* cited by examiner

SYSTEM AND METHOD FOR HANGING OBJECTS FROM A ROOF GUTTER

BACKGROUND AND SUMMARY

The present invention relates generally to removable hangers and, more particularly, to a system for hanging objects from the roof gutter of a house or building.

Presently, there is no commonly used method of efficiently, inexpensively and properly suspending items from the roof gutter of a house or building. A variety of improvised materials such as tape, rope/string, commercial hooks, staples, nails and other materials are often used to hang a wide variety of items from the roof gutter of a house or building. All of these materials tend to detract attention from the items being suspended because of their unsightly appearance.

Specialized hooks are available for hanging holiday lights and the like on the exterior of roof gutters. However, these hooks typically can only bear a limited amount of weight without deforming the gutter. As such, these hooks are usually not useful for hanging heavier items, such as flower pots and bird feeders.

The present disclosure relates to an easily installed, inexpensive system for hanging items from the inside of a roof gutter of a house or building. The system provides a hanger that attaches to an exterior of the inner wall of the gutter, thereby not interfering with the normal function of the gutter and providing for the hanging of relatively heavy items from the gutter, all without deforming the gutter. The system also includes an installation/removal tool which is used to install the hanger onto, and to remove the hanger from, a typical roof gutter. A variety of items, such as bird feeders, flower pots, flags, banners, sun screens, insect repellents, security devices and holiday decorations and lighting, can easily and conveniently be hung from the hanger, which is attached to the roof gutter.

The hanger, in its illustrative configuration, is generally flat and rectangular in shape. The hanger is illustratively fabricated or molded from a rigid material, such as metal or plastic. An upper end of the hanger may have an angled or bevelled edge to facilitate insertion between the inner wall of the gutter and the fascia board of the house or building. The illustrative hanger is inserted between an exterior surface of the inner wall of the gutter and the fascia board of the house or building, approximately midway between two adjacent gutter spikes or hangers that secure the gutter to the fascia board of the house or building. A retainer, illustratively a hook or lip on the upper end of the hanger, below the bevelled edge, attaches to the upper edge of the inner wall of the gutter. In its installed position, the hanger illustratively extends below the bottom surface of the gutter and the bottom edge of the fascia board. Coupling members, such as a plurality of holes, are illustratively provided near the lower end of the hanger to provide for the hanging of a wide variety of items from the gutter.

The installation/removal tool is illustratively a two-fingered rigid device, in which the fingers are separated to define a receiving cavity having a width slightly greater than the width of the hanger. Each finger illustratively includes a wedging blade, tapered on the outside of each upper end to allow the fingers to be easily inserted between the inner wall of the gutter and the fascia board of the house or building. The lower ends of the fingers are rigidly connected by a base or handle, in which a notch is provided to allow a clearance for the easy insertion of the hanger into the receiving cavity. The installation/removal tool is illustratively fabricated or molded from a rigid material such as metal or plastic.

An illustrative method for installing a roof gutter hanger system includes the step of providing a roof gutter, the gutter including an outer wall, an inner wall substantially parallel to the outer wall, and a base connecting the outer wall and the inner wall. The illustrative method further includes the steps of providing a support surface to which the inner wall of the gutter is attached, inserting a gutter hanger intermediate the support surface and the inner wall of the gutter, and retaining an upper end of the gutter hanger on the inner wall of the gutter.

A method for installing a roof gutter hanger system, including use of the installation/removal tool to aid in hanger installation, is also disclosed. The installation/removal tool is inserted between the inner wall of the gutter and the fascia board of the house or building, approximately midway between two adjacent gutter spikes or hangers that secure the gutter to the fascia board of the house or building. The installation/removal tool provides for a separation between the gutter and the fascia board for the easy insertion of the hanger. Once the installation/removal tool is positioned between the gutter and the fascia board, the hanger is inserted between the two fingers of the tool. The hanger is then attached to the upper edge of the inner wall of the gutter. The installation/removal tool is next pulled down to remove it from between the inner wall of the gutter and the fascia board. To remove the hanger from the gutter, the installation/removal tool is again inserted, straddling the hanger, between the gutter and the fascia board. The hanger is then disconnected from the upper edge of the inner wall of the gutter and pulled down for its removal. It should be noted that the installed hanger is relatively inconspicuous and therefore may be left installed on the gutter between uses.

Additional features will become apparent to those skilled in the art upon consideration of the following detailed description of the illustrative embodiments exemplifying the best mode as presently perceived.

BRIEF DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

DETAILED DESCRIPTION OF THE DRAWINGS

Figure 1:
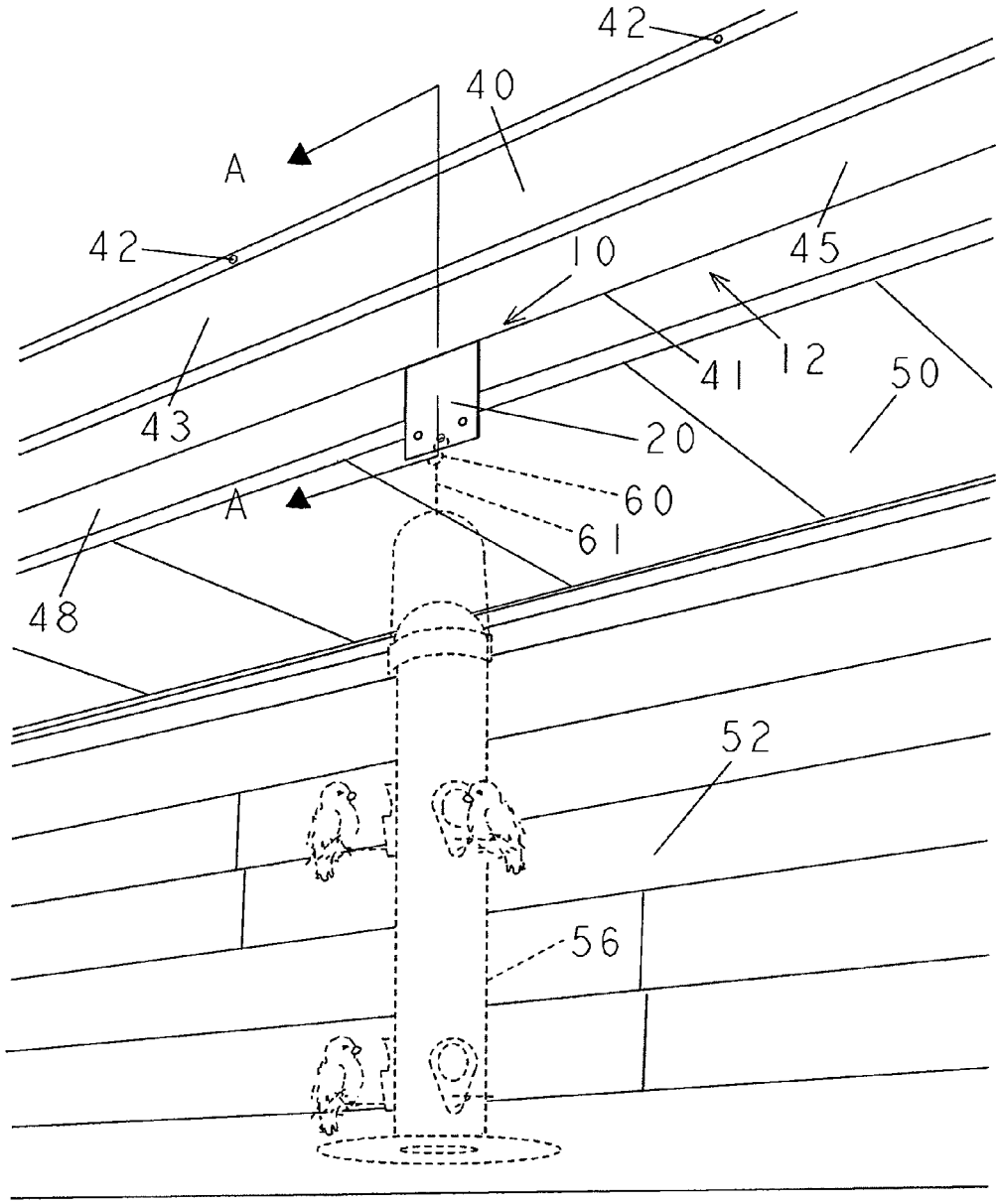
FIG. 1 is a perspective view of an illustrative embodiment hanger coupled to a roof gutter and supporting an accessory.

Corresponding reference characters indicate corresponding parts throughout several views. The drawings are not necessarily to scale, and certain features may be exaggerated to better illustrate and explain the embodiments. The exemplifications set out herein illustrate embodiments of the invention in several forms and are not to be construed as limiting the scope of the invention in any manner.

With reference to FIG. 1, an illustrative embodiment roof gutter hanger system 10 includes a hanger 20 for supporting an accessory, such as a bird feeder 56. The hanger 20 is illustratively inserted between a roof gutter 40 and a supporting surface, such as the fascia board 48 of the supporting structure 12 (e.g., house or building). The roof gutter 40 may be of conventional design configured to collect and convey water from a roof 44, and including spaced apart inner and outer walls 41 and 43 connected by a base 45. Additional details of the relationship between the hanger 20 and the gutter 40 and the fascia board 48 are shown, for example, in FIG. 3. The embodiment of FIG. 1 is further detailed in connection with FIG. 8, which shows a conventional downspout 54 coupled to the roof gutter 40 for directing water collected from the roof 44 to the ground 58.

Figure 2:
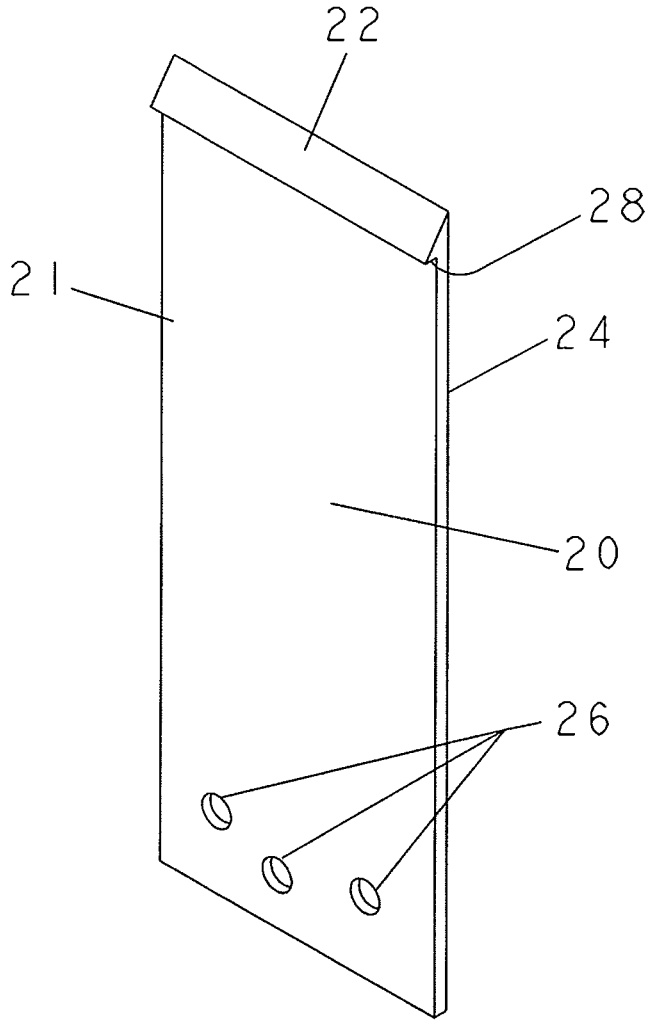
FIG. 2 is a perspective view of the hanger of FIG. 1.

The hanger 20 is further illustrated in FIG. 2. The hanger 20 illustratively includes a rigid elongated member or body 21 having a plurality of coupling members, such as holes 26, that accommodate the hanging of a wide variety of objects. The body 21 includes an extended thin section 24 that facilitates insertion of the hanger 20 between the gutter 40 and the fascia board 48, and for supporting the hanger holes 26 below the gutter 40 and the fascia board 48. An upper end of the hanger 20 features a bevelled edge or tapered hanger hook 22 that allows the body 21 to be easily inserted between the gutter 40 and the fascia board 48. A retainer, such as an attachment lip 28, is supported by the upper end of the hanger 20 opposite the bevelled edge 22. In other words, the culmination of the bevelled edge 22 provides for attachment lip 28 which is configured to connect to an upper edge 47 of the inner wall 41 of the gutter 40.

The hanger 20 is illustratively made of a rigid, corrosion and ultraviolet resistant material, for example a metal (e.g., aluminium alloy) or polymer (e.g., molded thermoplastic). The width of the hanger 20 may vary, depending upon what is being supported, but must easily fit between the adjacent attachment spikes or hangers 42 of the gutter 40. A typical distance between gutter spikes or hangers 42 is 16 inches. In one illustrative embodiment, the hanger 20 is 3 inches wide.

The length of the hanger 20 should be sufficient to allow the attachment holes 26 to extend below the bottom surfaces of the gutter 40 and the fascia board 48 to facilitate easy attachment of items to the hanger 20. In one illustrative embodiment, the hanger 20 is 7.63 inches long. The hanger 20 should have a minimum thickness sufficient to provide rigidity for the material chosen. The minimum thickness of an illustrative hanger body 21 formed of an aluminium alloy is approximately 0.19 inch. As detailed above, the upper end of the hanger 20 is tapered or bevelled to facilitate its insertion between the gutter 40 and the fascia board 48. The bevel is illustratively 30 degrees. The lower end of the taper provides for a "ledge," "hook" or attachment lip 28 for attachment to the upper edge 47 of the inner wall 41 of the gutter 40. The maximum thickness (at the attachment lip 28) of the illustrative hanger 20 is approximately 0.23 inches. The attachment lip 28 should be several times the thickness of the gutter material to facilitate attachment to the upper edge 47 of the inner wall 41 of the gutter 40. The illustrative hanger 20 has three (3) hanger holes 26, approximately 0.25 inches in diameter for the purpose of attaching various items that are to be hung.

Figure 3:
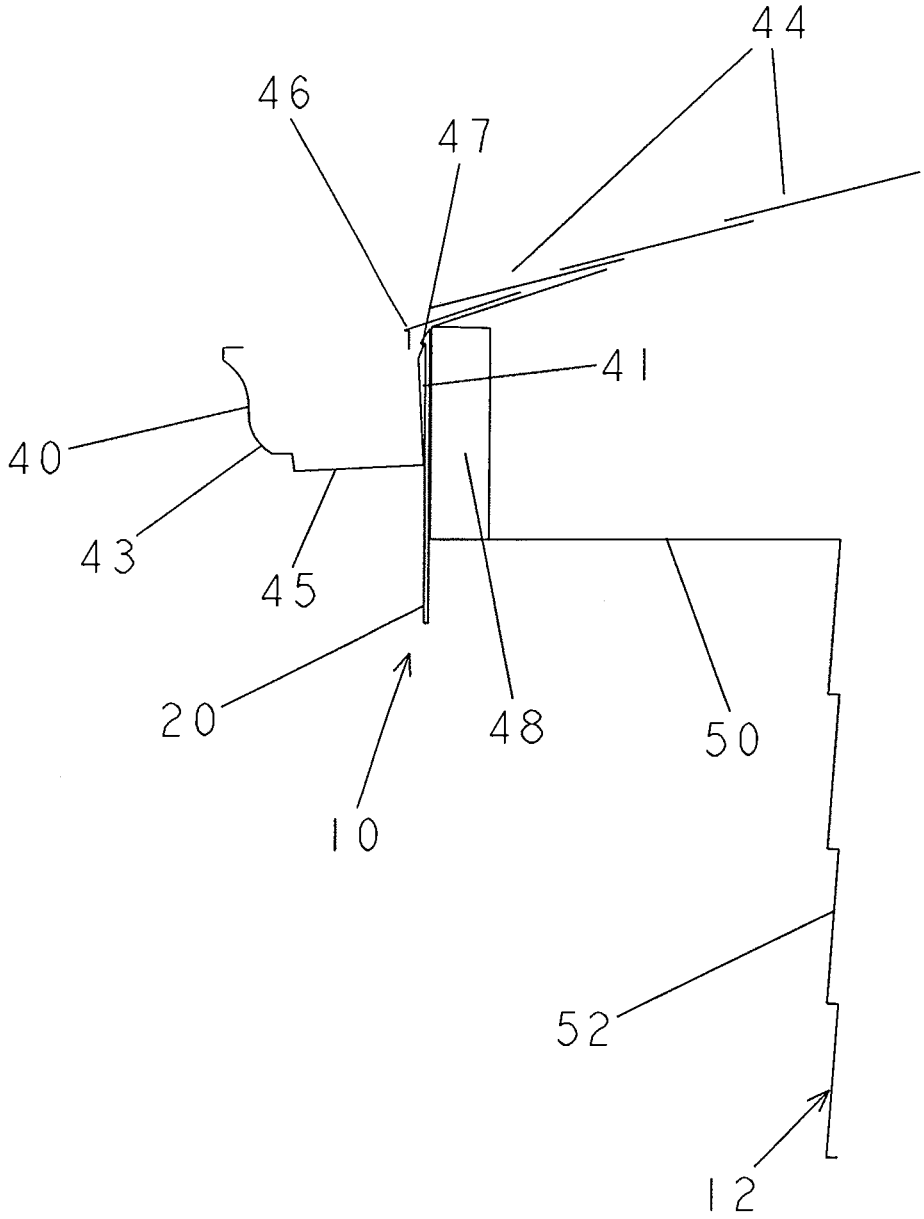
FIG. 3 is cross-sectional view taken along line A-A of FIG. 1.

FIG. 3 is a cross-sectional view taken along line A-A of FIG. 1, showing the hanger 20 in the installed position, being attached to the inner wall 41 of the gutter 40. More particularly, the body 21 of the hanger 20 is positioned between an exterior surface of the inner wall 41 of gutter 40 and the fascia board 48, while the attachment lip 28 is coupled to the upper edge 47 of the inner wall 41. FIG. 3 also shows the relative positions of the drip cap 46, the shingles of roof 44, the soffit 50 and the building siding 52.

Figure 4:
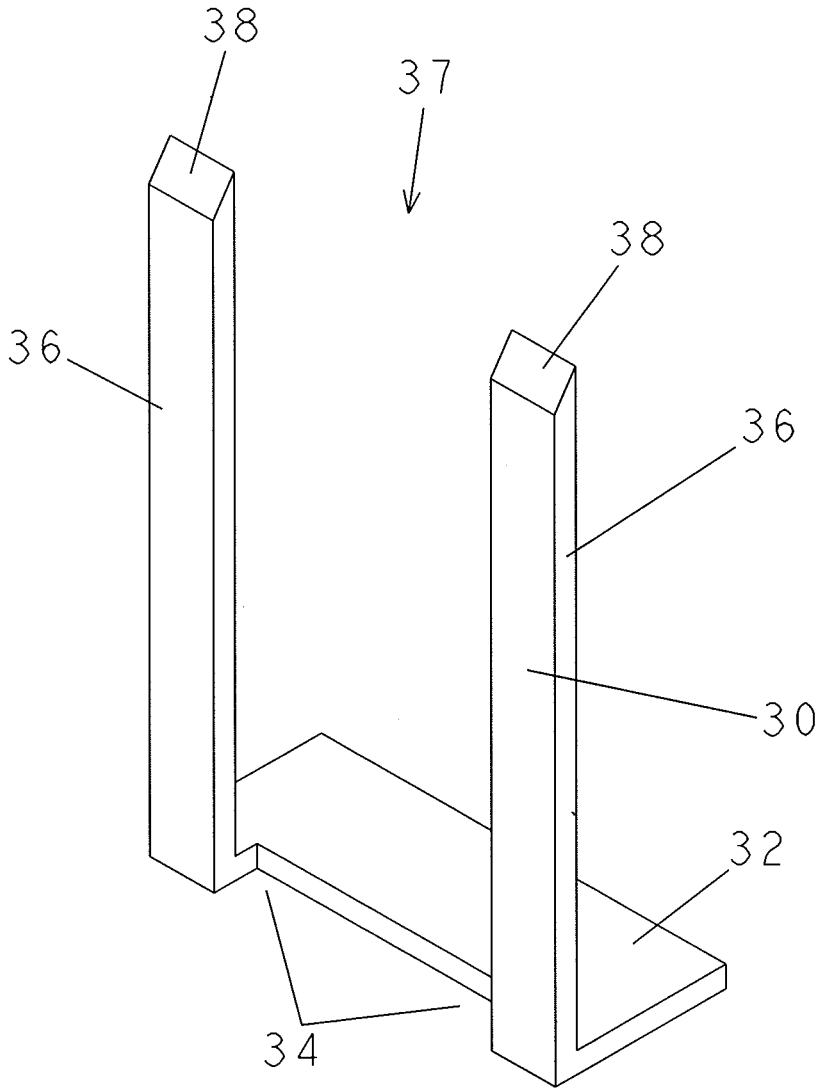
FIG. 4 is a perspective view of an illustrative embodiment installation/removal tool.

An illustrative embodiment installation/removal tool 30 is shown in FIG. 4. The combination of the hanger 20 and the installation/removal tool 30 defines gutter hanger kit or system 10. The installation/removal tool 30 illustratively includes a rigid member that is fully inserted between the gutter 40 and the fascia board 48, approximately midway between two gutter spikes or hangers 42 to facilitate the attachment or removal of the hanger 20 (where "d" represents the distance between adjacent gutter spikes or hangers 42, and "d/2" represents the approximate midpoint between such adjacent hangers 42). The installation/removal tool 30 features two vertically extending fingers or wedging blades 36, separated to define a receiving chamber 37 having a slightly greater width dimension than the width of the hanger 20. Angled edges or bevels 38 on the upper ends of each finger 36 facilitate easy insertion between the gutter 40 and the fascia board 48. The lower ends of fingers 36 are rigidly attached to a base or handle 32 that has a notch or clearance opening 34 that allows for the hanger 20 to be inserted into the receiving chamber 37. Illustratively, the thickness of each finger 36 is slightly larger than the maximum thickness of the hanger 20 (at the tapered or bevelled edge 22).

The installation/removal tool 30 is illustratively made of a rigid, corrosion and ultraviolet resistant material, such as a metal (e.g., welded aluminium alloy) or a polymer (e.g., molded thermoplastic). More particularly, in an illustrative embodiment the fingers 36 are welded to handle 32. The fingers 36 of the weldment are inserted between the gutter 40 and the fascia board 48 of the building 12. The fingers 36 of the installation/removal tool are each illustratively 0.25 inches thick. As detailed above, the end 38 of each finger 36 is tapered or bevelled (illustratively, by 30 degrees) to facilitate their insertion between the gutter 40 and the fascia board 48. The two fingers 36 are separated by a dimension of slightly greater than the width of the hanger 20, illustratively by 3.25 inches. Recess or notch 34 is provided in the handle 32 to allow for clearance between the fingers 36 when inserting the hanger 20 between the gutter 40 and the fascia board 48. The notch 34 is illustratively 0.50 inches deep. As further detailed herein, the tool 30 may be tapped (e.g., with a hammer), under the handle 32, to insert the fingers 36 of the tool 30 between the gutter 40 and the fascia board 48, particularly if the gutter 40 is tightly installed against the fascia board 48.

Figure 5:
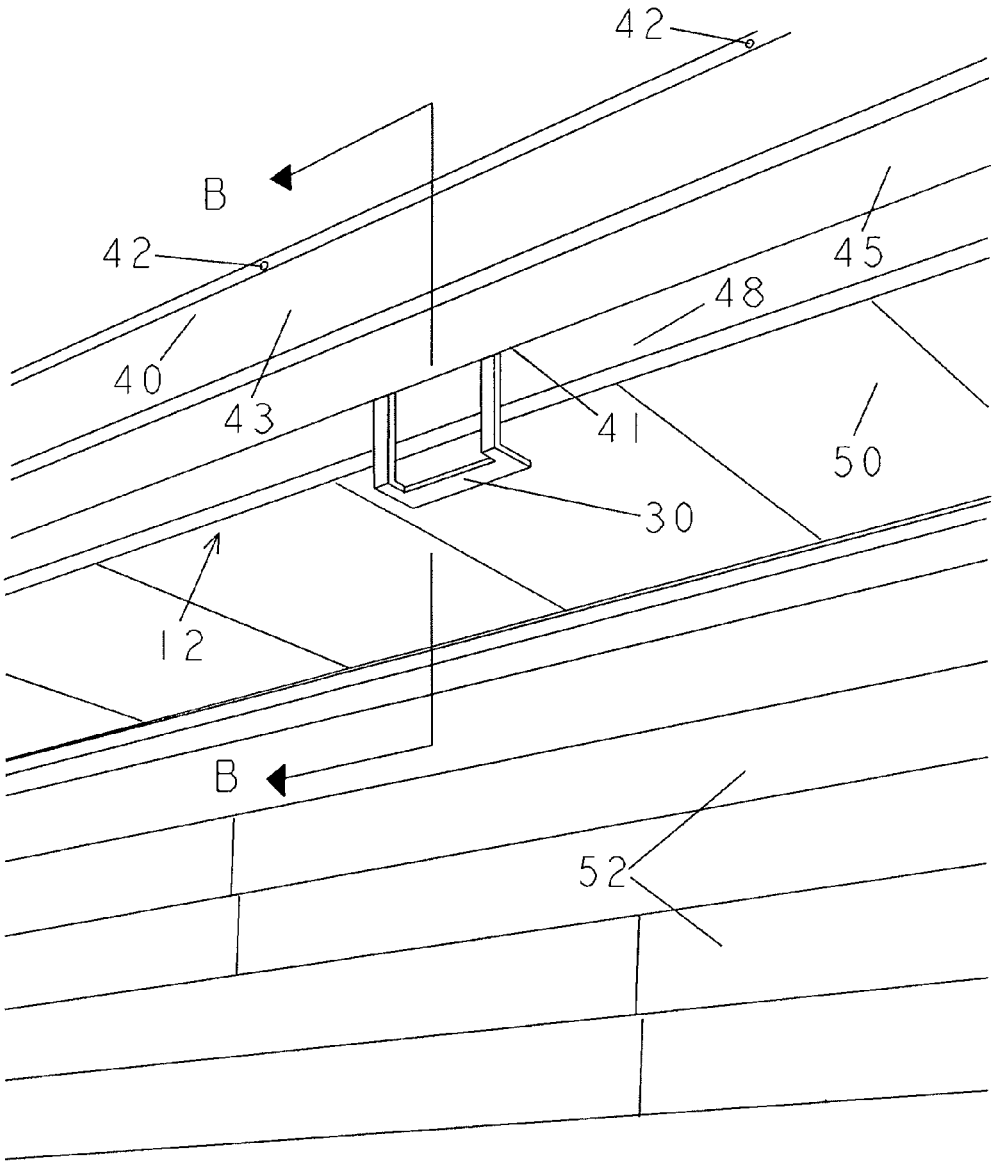
FIG. 5 is a perspective view of the installation/removal tool of FIG. 4 inserted between the roof gutter and the fascia board.
Figure 6:
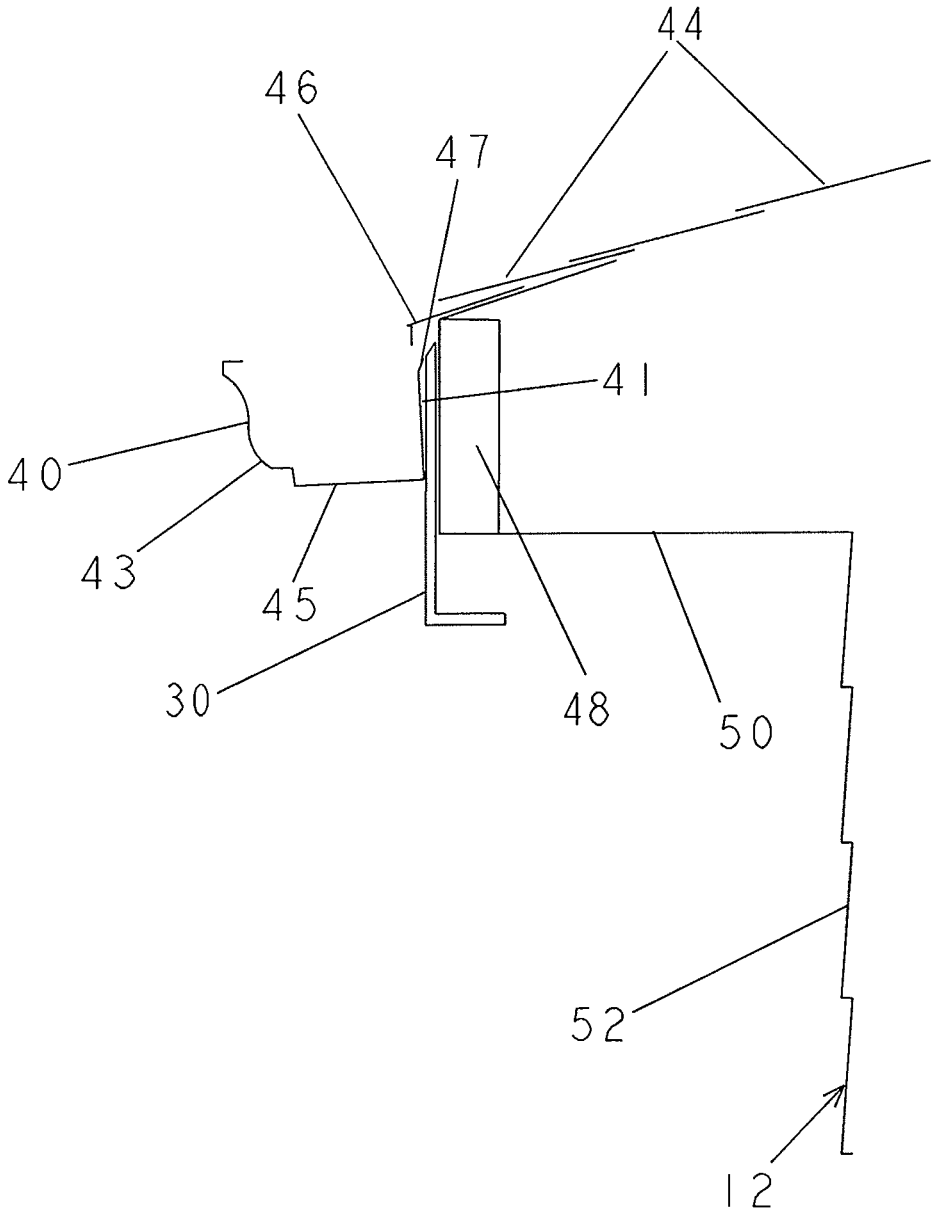
FIG. 6 is cross-sectional view taken along line B-B of FIG. 5.

FIG. 5 shows the installation/removal tool 30 in the fully inserted position, between the gutter 40 and the fascia board 48. Section B-B, taken from FIG. 5 is shown in FIG. 6. More particularly, FIG. 6 shows the installation/removal tool 30 fully inserted between the gutter 40 and the fascia board 48, prior to insertion of the hanger 20.

Figure 7:
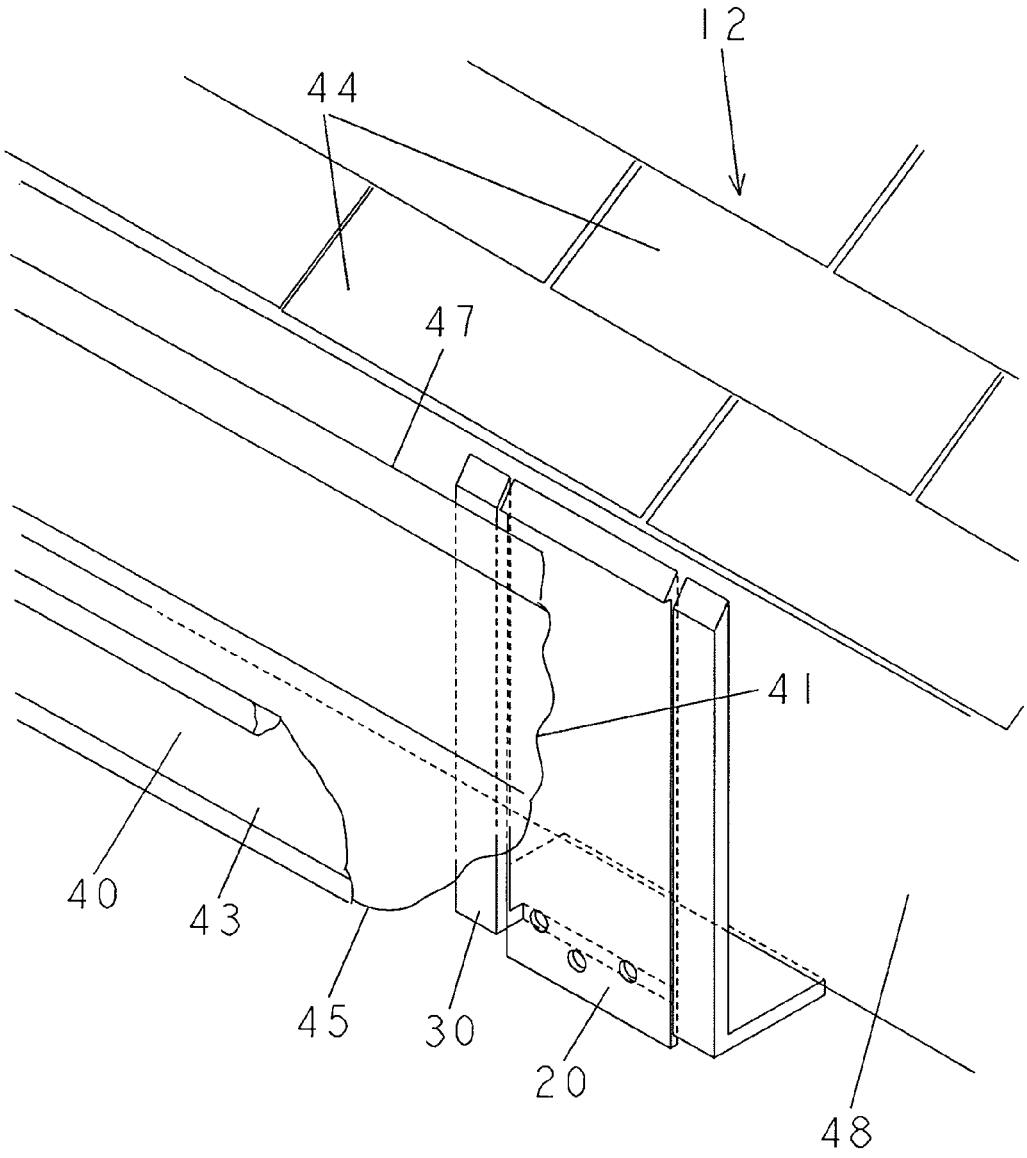
FIG. 7 is a perspective view of both the hanger and the installation/removal tool inserted between the roof gutter and the fascia board, with a partial cut-away of the gutter for clarity.

FIG. 7 shows the relationship between the hanger 20, the installation/removal tool 30, the gutter 40 and the fascia board 48 in the process of attaching or removing the hanger 20 onto or from the gutter 40.

An illustrative method for attaching the hanger 20 onto the gutter 40, with reference to FIGS. 1-7, is as follows:

(1) Fully insert the installation/removal tool 30 between the gutter 40 and the fascia board 48, approximately midway between two gutter spikes or hangers 42. A hammer or similar tool may be used to tap the tool 30 in place if the gutter 40 is tightly installed against the fascia board 48.

(2) Insert the hanger 20 within the receiving chamber 37 between the fingers 36 of the installation/removal tool 30, and between the gutter 40 and the fascia board 48.

(3) Attach the attachment lip 28 on the upper edge 47 of the inner wall 41 of the gutter 40.

(4) Remove the installation/removal tool 30 from between the gutter 40 and the fascia board 48.

An illustrative method for removing the hanger 20 from the gutter 40, with reference to FIGS. 1-7, is as follows:

(1) Fully insert the installation/removal tool 30 between the gutter 40 and the fascia board 48, straddling the hanger 20. A hammer or similar tool may be used to tap the tool 30 in place if the gutter 40 is tight against the fascia board 48.

(2) Press the hanger 20 against the fascia board 48 to disengage the attachment lip 28 from the upper edge 47 of the inner wall 41.

(3) Pull the hanger 20 down to remove it from between the gutter 40 and the fascia board 48.

Once the hanger 20 is installed onto the gutter 40, the hanger 20 is ready for objects or accessories to be suspended therefrom. Simple attachment devices, such as hooks 60, bolts/nuts or similar fasteners are used to attach the item to be hung to one or more of the hanger hole(s) 26. It should be noted that some of the embodiments described below may require more than one hanger 20. FIGS. 8 through 15 show d and d/2, above the gutter 40, for each hanger 20 to illustrate that the hanger 20 is positioned approximately midway, in distance, between adjacent gutter spikes or hangers 42.

FIGS. 8-15 illustrate various accessories that may be supported by one or more hangers 20. It should be appreciated that these accessories are only representative of the wide variety of accessories that may be used with illustrative hangers 20.

Figure 8:
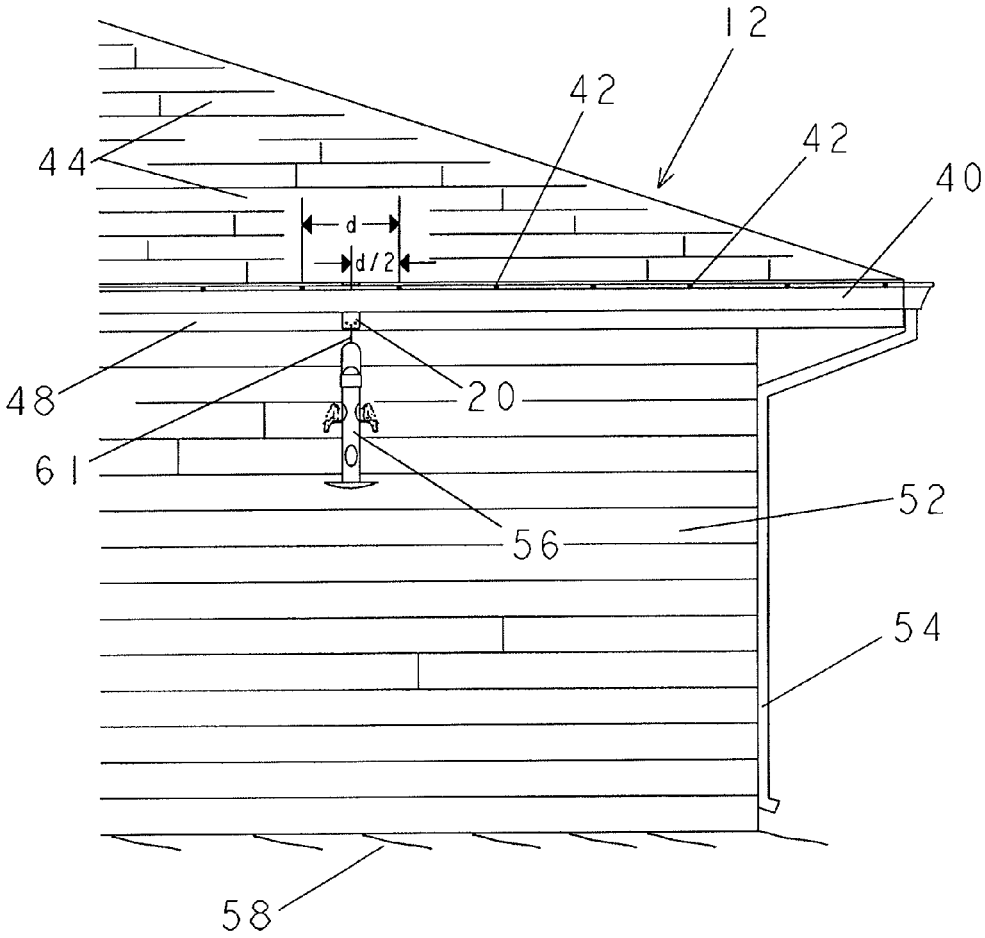
FIG. 8 is a side elevation view of an illustrative embodiment hanger being used to support a bird feeder.

FIGS. 1 and 8 show the hanger 20 being used to hang a bird feeder 56 from the inner wall 41 of roof gutter 40. A hook 60 is illustratively received within attachment hole 26 on lower end of hanger 20. A chain, wire, or cable 61 may connect hook 60 to bird feeder 56.

Figure 9:
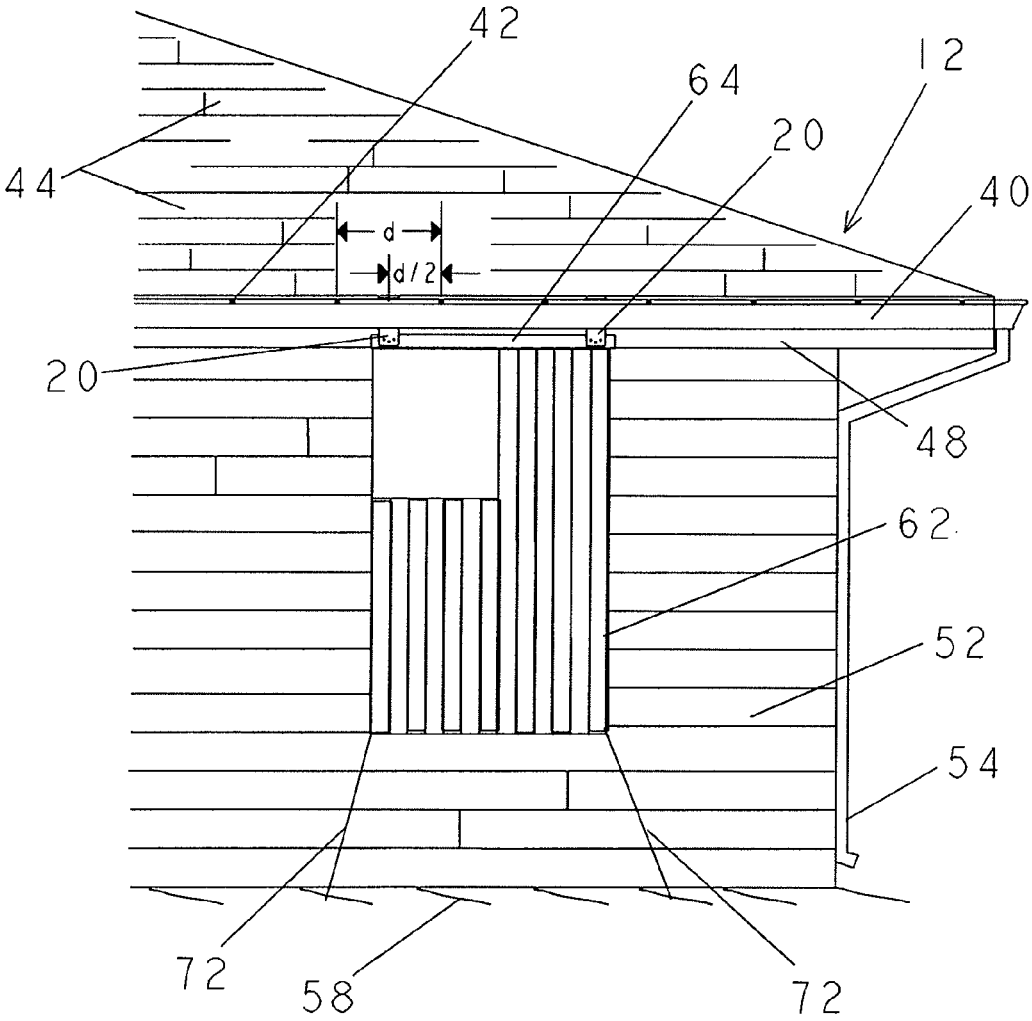
FIG. 9 is a side elevation view of a pair of illustrative embodiment hangers being used to support a flag or banner.

FIG. 9 shows a pair of spaced apart hangers 20 being used to hang a flag or banner 62 from the inner wall 41 of roof gutter 40. A stabilizer bar 64 extends between the hangers 20 and supports the flag 62. Tie downs 72 may couple a lower end of the flag 62 to the ground 58.

Figure 10:
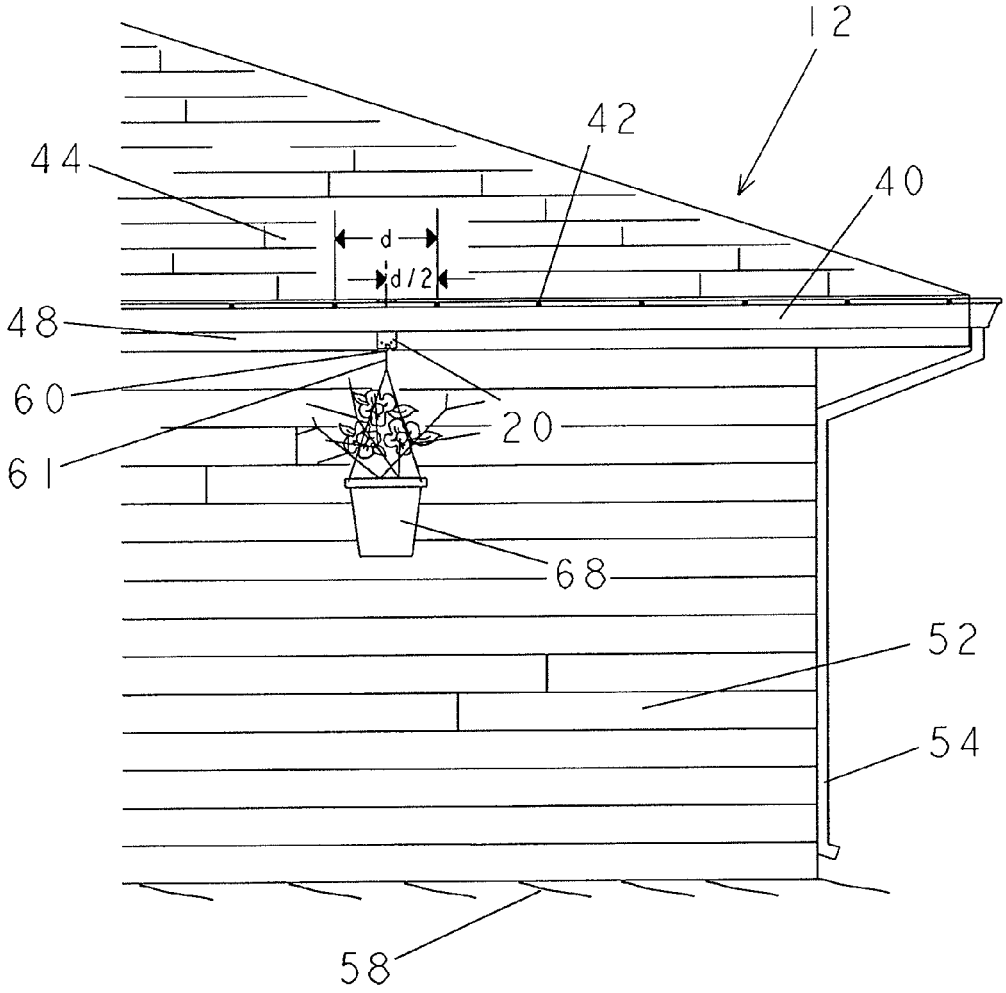
FIG. 10 is a side elevation view of an illustrative embodiment hanger being used to support a flower pot.

FIG. 10 shows the hanger 20 being used to hang a flower pot 68 from the inner wall 41 of roof gutter 40. Again, hook 60 is received within attachment hole 26 on lower end of hanger 20. A chain, wire, or cable 61 may connect hook 60 to flower pot 68.

Figure 11:
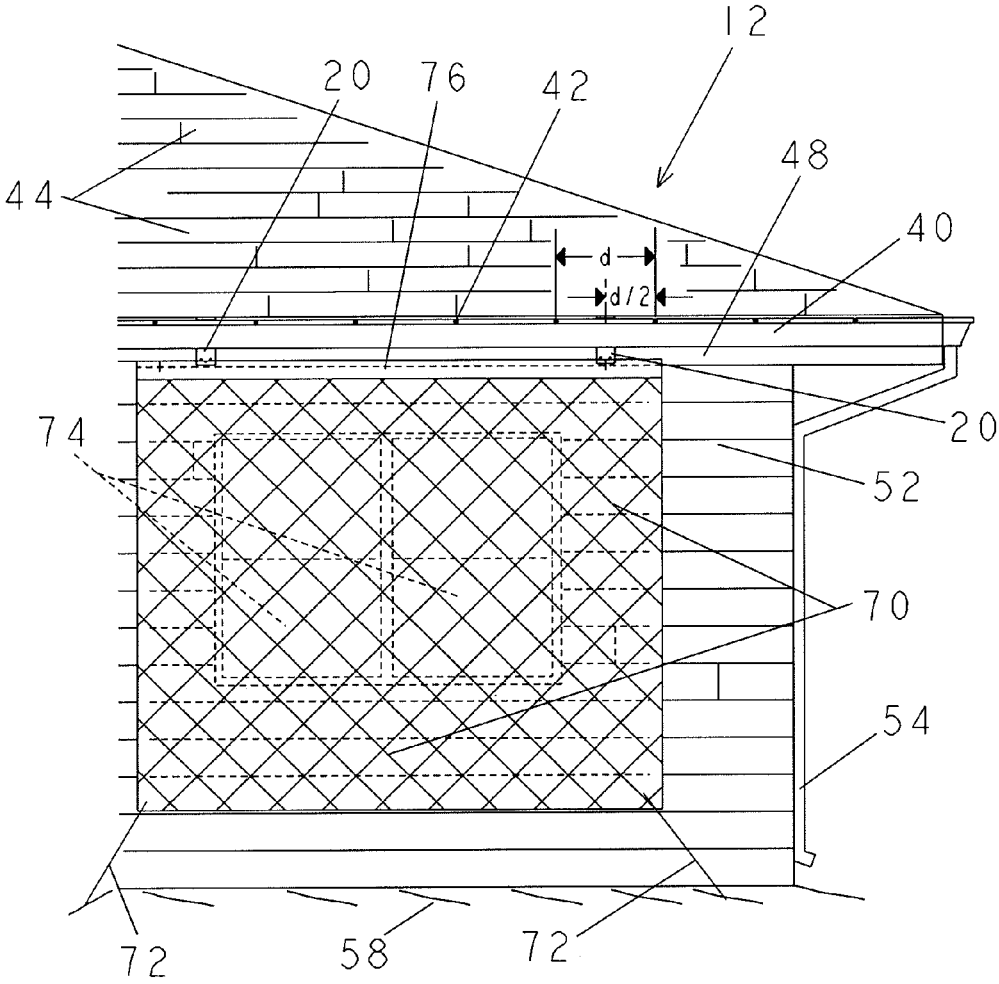
FIG. 11 is a side elevation view of a pair of illustrative embodiment hangers being used to support a sun screen.

FIG. 11 shows the hanger(s) 20 being used to hang a sun screen 70 from the inner wall 41 of roof gutter 40 in front of windows 74. Again, a stabilizer bar 76 extends between the hangers 20 and supports the sun screen 70. Tie downs 72 may couple a lower end of the sun screen 70 to the ground 58.

Figure 12:
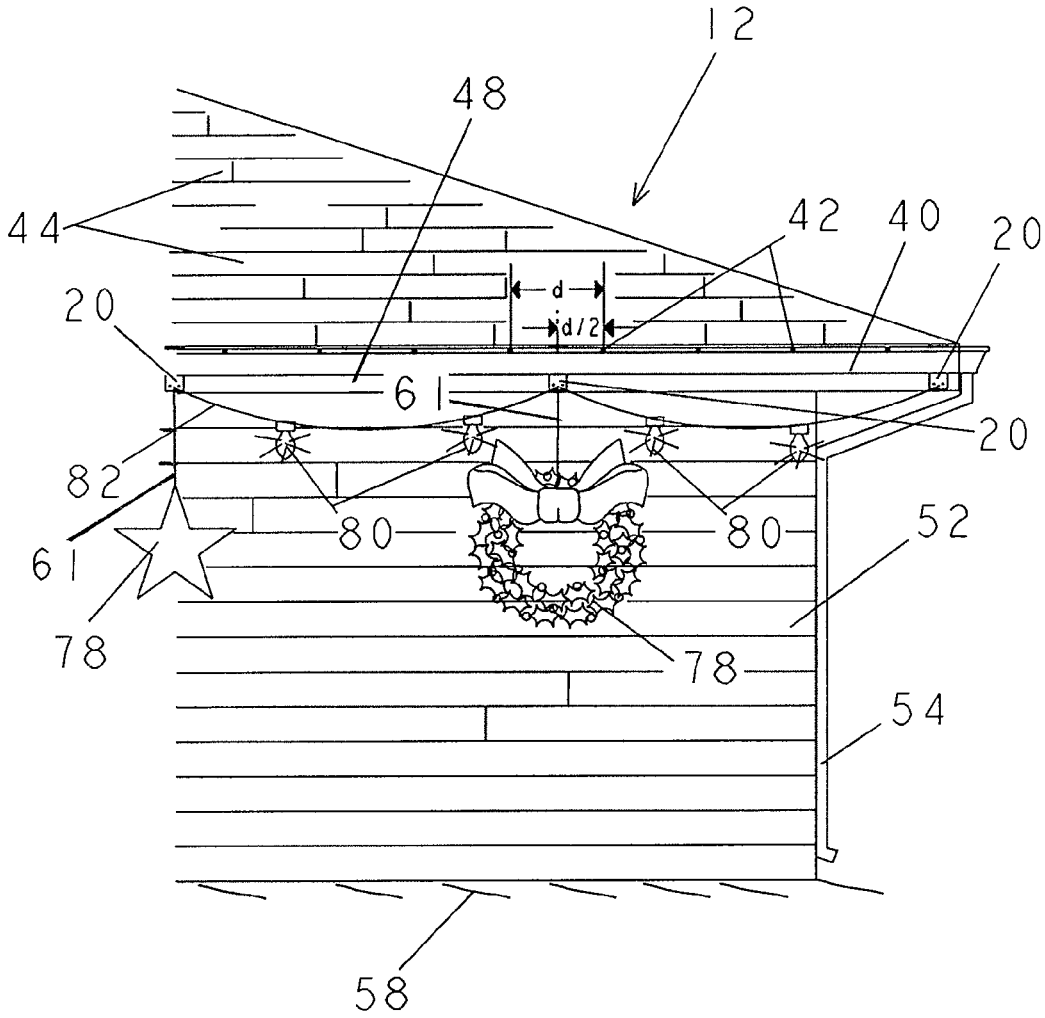
FIG. 12 is a side elevation view of a pair of illustrative embodiment hangers being used to support holiday lights and decorations.

FIG. 12 shows the hanger(s) 20 being used to hang decorations 78, decorative lights 80 and necessary electrical wiring 82 from the inner wall 41 of roof gutter 40.

Figure 13:
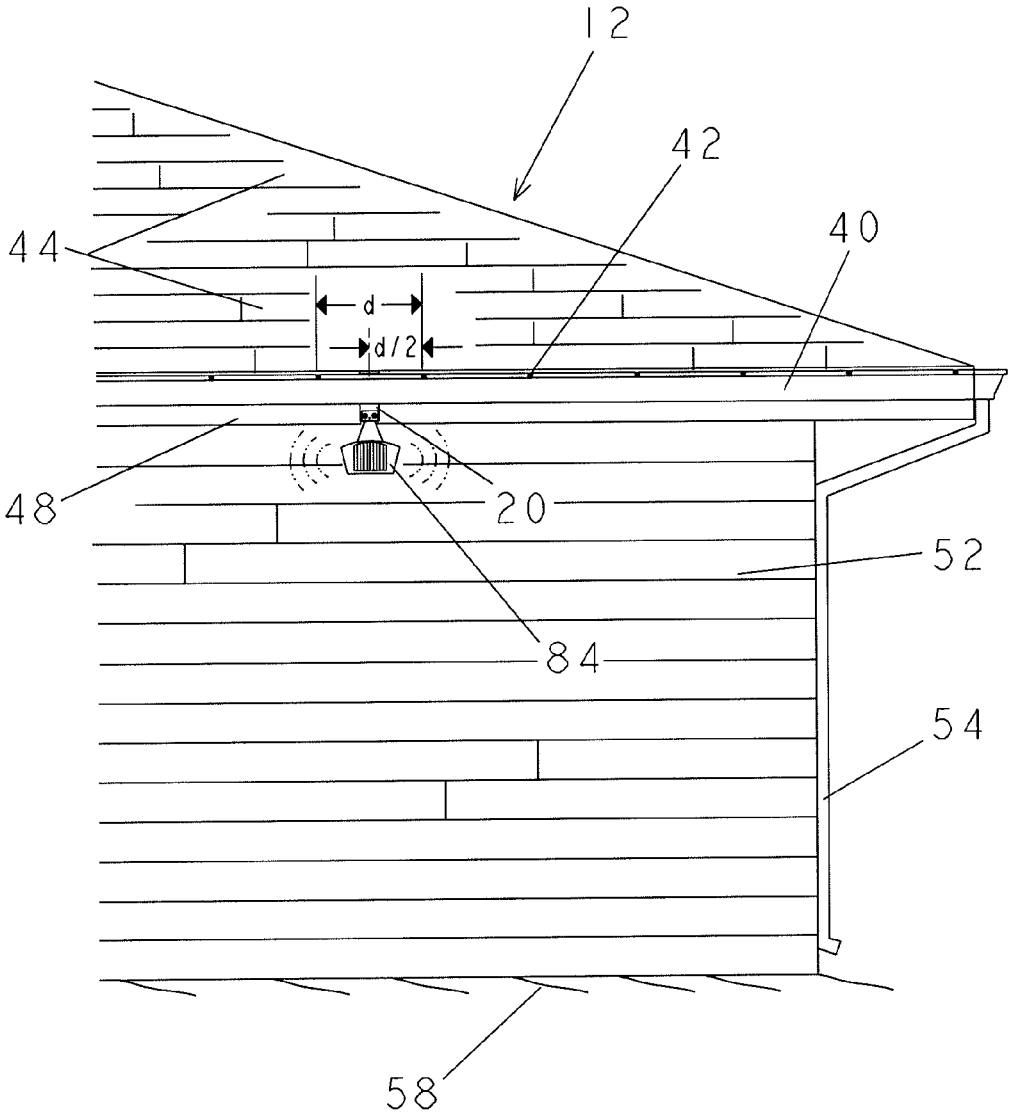
FIG. 13 is a side elevation view of an illustrative embodiment hanger being used to support an intrusion detection device.

FIG. 13 shows the hanger 20 being used to support a security sensor 84 from the inner wall 41 of roof gutter 40. The security sensor 84 may be a conventional motion sensing device.

Figure 14:
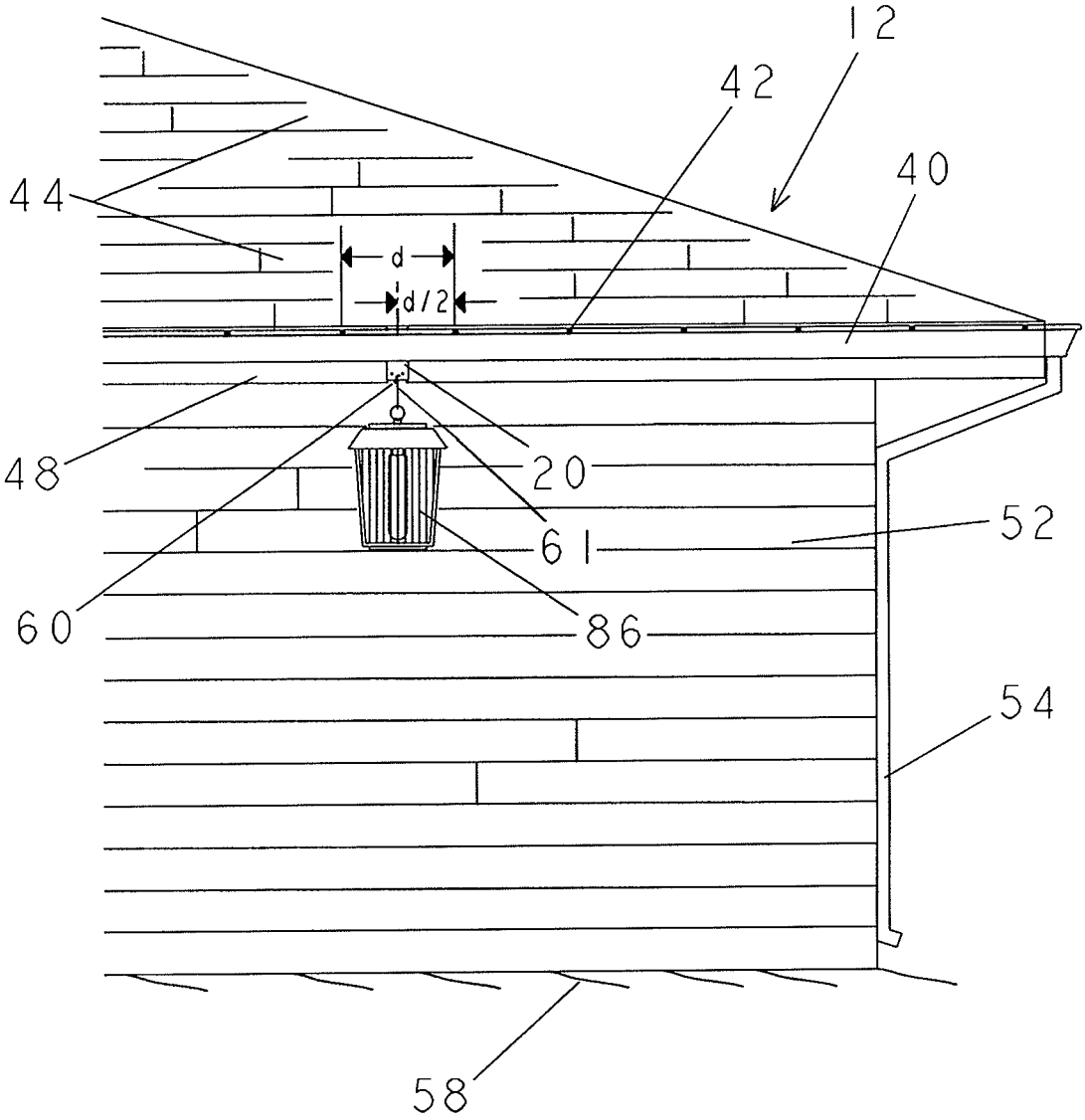
FIG. 14 is a side elevation view of an illustrative embodiment hanger being used to support an insect repellent device.

FIG. 14 shows the hanger 20 being used to support an insect repellent 86 from the inner wall 41 of roof gutter 40. The insect repellent 86 may be a conventional electric insect repelling device, for example a device dispensing an airborne repellent or generating an electric charge.

Figure 15:
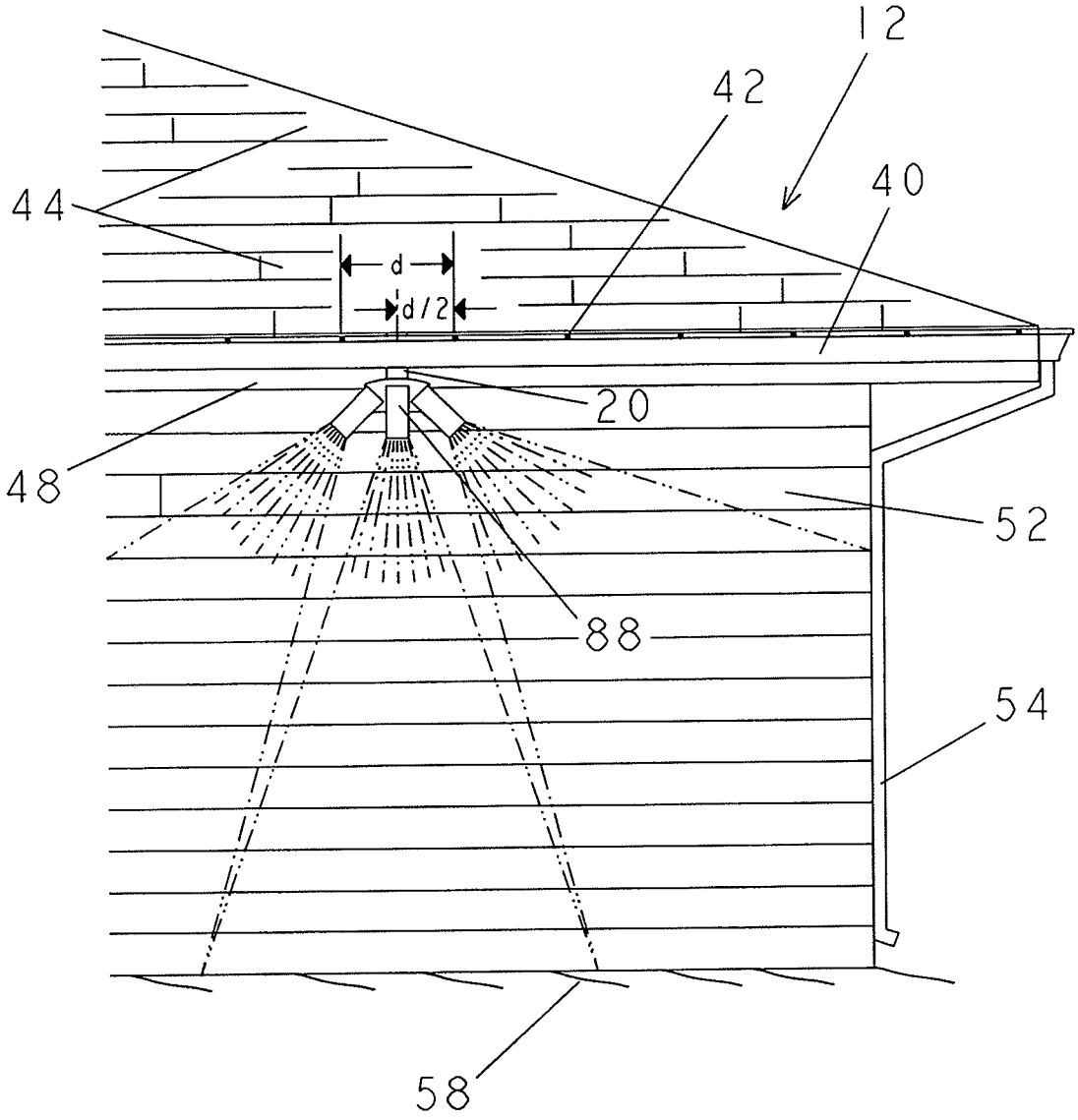
FIG. 15 is a side elevation view of an illustrative embodiment of the hanger being used to support security light devices.

FIG. 15 shows the hanger 20 being used to support security lighting 88 from the inner wall 41 of roof gutter 40.

Although the invention has been described in detail with reference to certain preferred embodiments, variations and modifications exist within the spirit and scope of the invention as described and defined in the following claims.

The invention claimed is:

1. A gutter hanger system for supporting an accessory below a pre-installed gutter, the gutter hanger system comprising:

a pre-installed gutter configured to collect water from a roof, said pre-installed gutter including an outer wall, an inner wall spaced apart from said outer wall, and a base connecting said outer wall and said inner wall, said inner wall including an upper edge facing upwardly toward the roof;

a support surface supporting said inner wall of said pre-installed gutter; and a removable gutter hanger including opposing upper and lower ends, said lower end freely suspended below said base, a coupling member located at said lower end and accessible from an outer surface for supporting an accessory, and a retainer located at said upper end and supported by said inner wall, where said gutter hanger is positioned intermediate said inner wall and said support surface, oriented in a downward direction such that said coupling member is positioned below said base, and said retainer includes a hanger hook having a lip that extends outward from said upper end of said gutter hanger and rests upon on the upper edge of said inner wall.

2. The gutter hanger system of claim 1, wherein said retainer further includes an angled upper surface above said lip to assist in insertion between said inner wall and said support surface.

3. The gutter hanger system of claim 1, wherein said gutter hanger is made of a rigid, corrosion resistant, and ultraviolet resistant material.

4. The gutter hanger system of claim 1, wherein said accessory includes at least one of the following: a bird feeder, a banner, a flower pot, a sun screen, an intrusion detection device, an insect repellant device, a security light device, and holiday decorations.

5. The gutter hanger system of claim 1, wherein said support surface includes the fascia board of a building.

6. A gutter hanger system for supporting an accessory below a pre-installed gutter coupled to a fascia board, the gutter hanger system comprising:

a pre-installed gutter configured to collect water from a roof, said pre-installed gutter including an outer wall, an inner wall spaced apart from said outer wall, and a base connecting said outer wall and said inner wall, said inner wall including an upper edge facing upwardly toward the roof;

a removable gutter hanger, including an elongated hanger body defining a longitudinal axis between opposing upper and lower ends, said upper end including an upwardly facing beveled edge to facilitate insertion between said gutter and a fascia board, and a downwardly facing attachment lip opposite said beveled edge configured to be supported by said upper edge of said inner wall of the gutter, the upper edge facing upwardly toward a roof drip cap, and said lower end freely suspended below said base and including an outwardly facing opening to receive a hook for suspending an accessory.

7. The gutter hanger system of claim 6, wherein said hanger body includes opposing top and bottom ends, a coupling member located at said bottom end, and a retainer located at said top end.

8. The gutter hanger system of claim 6, further comprising a hanger installation/removal tool, said hanger installation/removal tool including a first wedging blade having a tapered edge and extending parallel to said longitudinal axis of said hanger body, said hanger installation/removal tool configured to be inserted between the gutter and the fascia board prior to inserting said gutter hanger.

9. The gutter hanger system of claim 8, wherein said hanger installation/removal tool further includes:

a second wedging blade having a tapered edge, said second wedging blade located parallel and coplanar to said first wedging blade;

a receiving cavity defined intermediate said first wedging blade and said second wedging blade, said receiving cavity configured to releasably receive said hanger body; and a handle coupled with said first wedging blade and said second wedging blade, said handle positioned below said receiving cavity and extending perpendicular to the plane of said first wedging blade and said second wedging blade.

10. The gutter hanger system of claim 9, wherein said handle includes a tool impact surface.

11. The gutter hanger system of claim 8, wherein:

said hanger installation/removal tool further includes a second wedging blade having a tapered edge, said second wedging blade located parallel and coplanar to said first wedging blade, a receiving cavity defined intermediate said first wedging blade and said second wedging blade, said receiving cavity configured to releasably receive said hanger body, and a handle coupled with said first wedging blade and said second wedging blade, said handle positioned below said receiving cavity and extending perpendicular to the plane of said first wedging blade and said second wedging blade; and said hanger body includes opposing top and bottom ends, a coupling member located at said bottom end, and a retainer located at said top end.

12. The gutter hanger system of claim 8, wherein said hanger installation/removal tool is made of a rigid material.

13. A method of installing a gutter hanger system to a pre-installed gutter, the steps comprising:

providing a gutter, said gutter including an outer wall, an inner wall spaced apart from said outer wall, and a base connecting said outer wall and said inner wall, said inner wall including an upper edge facing upwardly toward a roof;

providing a support surface to which said inner wall of said gutter is attached;

providing a removable gutter hanger including an elongated hanger body including opposing upper and lower ends, the upper end including a hanger hook having an upwardly facing beveled edge, and a downwardly facing attachment lip opposite the beveled edge;

inserting the beveled edge of the gutter hanger upwardly from below said base of said gutter intermediate said support surface and said inner wall of said gutter;

retaining the attachment lip of the upper end of said gutter hanger on the upper edge of said inner wall of said gutter;

supporting a coupling member of said gutter hanger below said base of said gutter, wherein said lower end is freely suspended below said base; and coupling an accessory to said coupling member of said gutter hanger, wherein said accessory is suspended below said base.

14. The method of claim 13, wherein said retaining step includes placing said gutter hanger in a downwardly-oriented direction such that said lip rests atop said inner wall of said gutter.

15. The method of claim 13, further comprising the step of inserting a hanger installation/removal tool intermediate said gutter and said support surface prior to the step of inserting said hanger.

16. The method of claim 15, wherein:

said hanger installation/removal tool includes two wedging blades having tapered edges, said wedging blades located parallel and coplanar with each other, a receiving cavity defined intermediate said wedging blades, said receiving cavity configured to releasably receive said gutter hanger, and a handle coupled with said wedging blades, said handle positioned below said receiving cavity and extending perpendicular to the plane of said first wedging blades; and said inserting step includes positioning said gutter hanger within said receiving cavity, and inserting said hanger installation/removal tool and said gutter hanger as an assembly intermediate said inner wall of said gutter and said support surface.

17. The method of claim 16, further comprising the step of removing said hanger installation/removal tool from intermediate said inner wall of said gutter and said support surface, while said gutter hanger remains intermediate said gutter and said support surface.

18. The method of claim 16, further comprising the step of removing said gutter hanger from between said gutter and said support surface.

* * * * *